US007578579B2

(12) United States Patent
Sugahara

(10) Patent No.: US 7,578,579 B2
(45) Date of Patent: Aug. 25, 2009

(54) INKJET RECORDING HEAD

(75) Inventor: Hiroto Sugahara, Ama-gun (JP)

(73) Assignee: Brother Kogyo Kabushiki Kaisha (JP)

( * ) Notice: Subject to any disclaimer, the term of this patent is extended or adjusted under 35 U.S.C. 154(b) by 438 days.

(21) Appl. No.: 11/147,233

(22) Filed: Jun. 8, 2005

(65) Prior Publication Data

US 2005/0270339 A1 Dec. 8, 2005

(30) Foreign Application Priority Data

Jun. 8, 2004 (JP) ..... 2004-169280

(51) Int. Cl.
*B41J 2/14* (2006.01)
*B41J 2/045* (2006.01)

(52) U.S. Cl. ..... 347/50; 347/71

(58) Field of Classification Search ..... 347/68–72, 347/50, 58

See application file for complete search history.

(56) References Cited

U.S. PATENT DOCUMENTS

| | | | | |
|---|---|---|---|---|
| 6,070,972 | A * | 6/2000 | Thiel | 347/71 |
| 6,290,333 | B1 | 9/2001 | Wade et al. | |
| 6,471,342 | B1 | 10/2002 | Horio et al. | |
| 6,497,477 | B1 | 12/2002 | Nakamura et al. | |
| 2002/0080215 | A1 * | 6/2002 | Sakaida et al. | 347/71 |

FOREIGN PATENT DOCUMENTS

| | | |
|---|---|---|
| JP | 11-314366 A | 11/1999 |
| JP | 2000351208 | 12/2000 |
| JP | 3267937 | 1/2002 |
| JP | 2003-159798 | 6/2003 |

* cited by examiner

*Primary Examiner*—Stephen D Meier
*Assistant Examiner*—Geoffrey Mruk
(74) *Attorney, Agent, or Firm*—Banner & Witcoff, Ltd.

(57) ABSTRACT

An inkjet recording head, including a channel unit which has, along a reference plane, a plurality of pressure chambers communicating with a plurality of nozzles, respectively, each of which ejects a droplet of ink; and a piezoelectric actuator which changes a volume of an arbitrary one of the pressure chambers so that a corresponding one of the nozzles ejects the droplet of ink. The piezoelectric actuator includes a plurality of individual electrodes corresponding to the plurality of pressure chambers, respectively, a common electrode which is opposed to each of the individual electrodes, a piezoelectric layer which is interposed between the individual electrodes and the common electrode, and a plurality of electric wires which are connected to the plurality of individual electrodes, respectively, so as to supply respective drive voltages to the individual electrodes. A portion of at least one of the electric wires that is connected to at least one first individual electrode of the individual electrodes that corresponds to at least one first pressure chamber of the pressure chambers overlaps, as seen in a direction perpendicular to the reference plane, a portion of at least one second pressure chamber of the pressure chambers that differs from the at least one first pressure chamber.

14 Claims, 12 Drawing Sheets

INKJET RECORDING HEAD

The present application is based on Japanese Patent Application No. 2004-169280 filed on Jun. 8, 2004, the contents of which are incorporated herein by reference.

BACKGROUND OF THE INVENTION

1. Field of the Invention

The present invention relates to an inkjet recording head that ejects ink toward a recording medium and thereby carries out recording on the medium.

2. Discussion of Related Art

Patent Document 1 (Japanese Patent Application Publication No. 2003-159798) or Patent Document 2 (Japanese Patent No. 3267937 or its corresponding U.S. Pat. No. 6,471,342) discloses an inkjet recording head that ejects ink toward a recording medium and thereby carries out recording on the medium. The disclosed inkjet recording head includes a channel unit having a plurality of pressure chambers communicating with a plurality of nozzles, respectively; and a piezoelectric actuator that selectively changes a volume or respective volumes of an arbitrary one or ones of the pressure chambers. The piezoelectric actuator includes a plurality of individual electrodes corresponding to the pressure chambers, respectively; a common electrode that is opposed to each of the individual electrodes and may be constituted by a diaphragm; a piezoelectric layer that is interposed between the individual electrodes and the common electrode; and a plurality of electric wires that are connected to the individual electrodes, respectively, so as to supply respective drive voltages thereto. In this piezoelectric actuator, the electric wires are located, as seen in a direction perpendicular to a reference plane along which the pressure chambers are provided, in areas corresponding to areas present between the pressure chambers, such that each of the electric wires does not overlap any pressure chambers other than the pressure chamber corresponding to the individual electrode to which the each electric wire is connected. In the piezoelectric actuator, when a drive voltage is supplied to an arbitrary one of the individual electrodes via a corresponding one of the electric wires, an electric field is generated in a portion of the piezoelectric layer that is located between the one individual electrode and the common electrode, so that that portion of the piezoelectric layer is deformed. This deformation of the piezoelectric layer changes the volume of the pressure chamber corresponding to the one individual electrode to which the drive voltage is supplied, and thereby applies a pressure to ink present in the pressure chamber.

Meanwhile, recently, there has been a demand for such an inkjet recording head that satisfies both the requirement to improve printing quality and the requirement to reduce the size of the head. To this end, it has been proposed to form a plurality of pressure chambers at a high density. However, if, in the piezoelectric actuator, as disclosed by the above-indicated Patent Document 1 or 2, wherein the electric wires extending from the pressure chambers are located in the areas corresponding to the areas between the pressure chambers, the pressure chambers are formed at a higher density, then it is needed to reduce the areas in which the electric wires are located and decrease a pitch at which the wires are provided. And, if the pitch of provision of the electric wires is decreased, then the production cost of the piezoelectric actuator is raised, the production yield of the same is lowered, and the reliability with which the electric wires are electrically connected to the individual electrodes so as to supply the drive voltages thereto is lowered.

SUMMARY OF THE INVENTION

It is therefore an object of the present invention to provide an inkjet recording head that is free from at least one of the above-identified problems. It is another object of the present invention to provide an inkjet recording head including a piezoelectric actuator in which electric wires connected to individual electrodes can be provided in a wider area.

According to the present invention, there is provided an inkjet recording head, comprising a channel unit which has, along a reference plane, a plurality of pressure chambers communicating with a plurality of nozzles, respectively, each of which ejects a droplet of ink; and a piezoelectric actuator which changes a volume of an arbitrary one of the pressure chambers so that a corresponding one of the nozzles ejects the droplet of ink. The piezoelectric actuator includes a plurality of individual electrodes corresponding to the plurality of pressure chambers, respectively; a common electrode which is opposed to each of the individual electrodes; a piezoelectric layer which is interposed between the individual electrodes and the common electrode; and a plurality of electric wires which are connected to the plurality of individual electrodes, respectively, so as to supply respective drive voltages to the individual electrodes. A portion of at least one of the electric wires that is connected to at least one first individual electrode of the individual electrodes that corresponds to at least one first pressure chamber of the pressure chambers overlaps, as seen in a direction perpendicular to the reference plane, a portion of at least one second pressure chamber of the pressure chambers that differs from the at least one first pressure chamber.

In the present inkjet recording head, when a drive voltage is supplied to an arbitrary one of the individual electrodes via a corresponding one of the electric wires, an electric field is generated in a portion of the piezoelectric layer that is located between the one individual electrode and the common electrode, so that that portion of the piezoelectric layer is deformed. This deformation of the piezoelectric layer results in changing a volume of one of the pressure chambers that corresponds to the one individual electrode and thereby applying a pressure to the ink present in the one pressure chamber, so that the nozzle communicating with the one pressure chamber ejects a droplet of the ink toward a recording medium such as a recording sheet.

In the present inkjet recording head, the electric wires include not only respective portions that do not overlap, as seen in the direction perpendicular to the reference plane along which the pressure chambers are provided, any of the pressure chambers, but also one or more portions that is or are connected to one or more first individual electrodes corresponding to one or more first pressure chambers and overlaps or overlap, as seen in that direction, a portion or respective portions of one or more second pressure chambers differing from the one or more first pressure chambers. Therefore, the electric wires can be provided in one or more wider areas, and accordingly the density at which the electric wires are provided can be decreased. Thus, the increase of the production cost and/or the decrease of the production yield can be avoided. In addition, the electric wires that are connected to the individual electrodes so as to supply the drive voltages to the same can be provided with improved reliability. Otherwise, the total number of the pressure chambers can be increased without changing the wire density. In the latter case, the inkjet recording head can carry out printing operations at higher speeds and with higher qualities.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
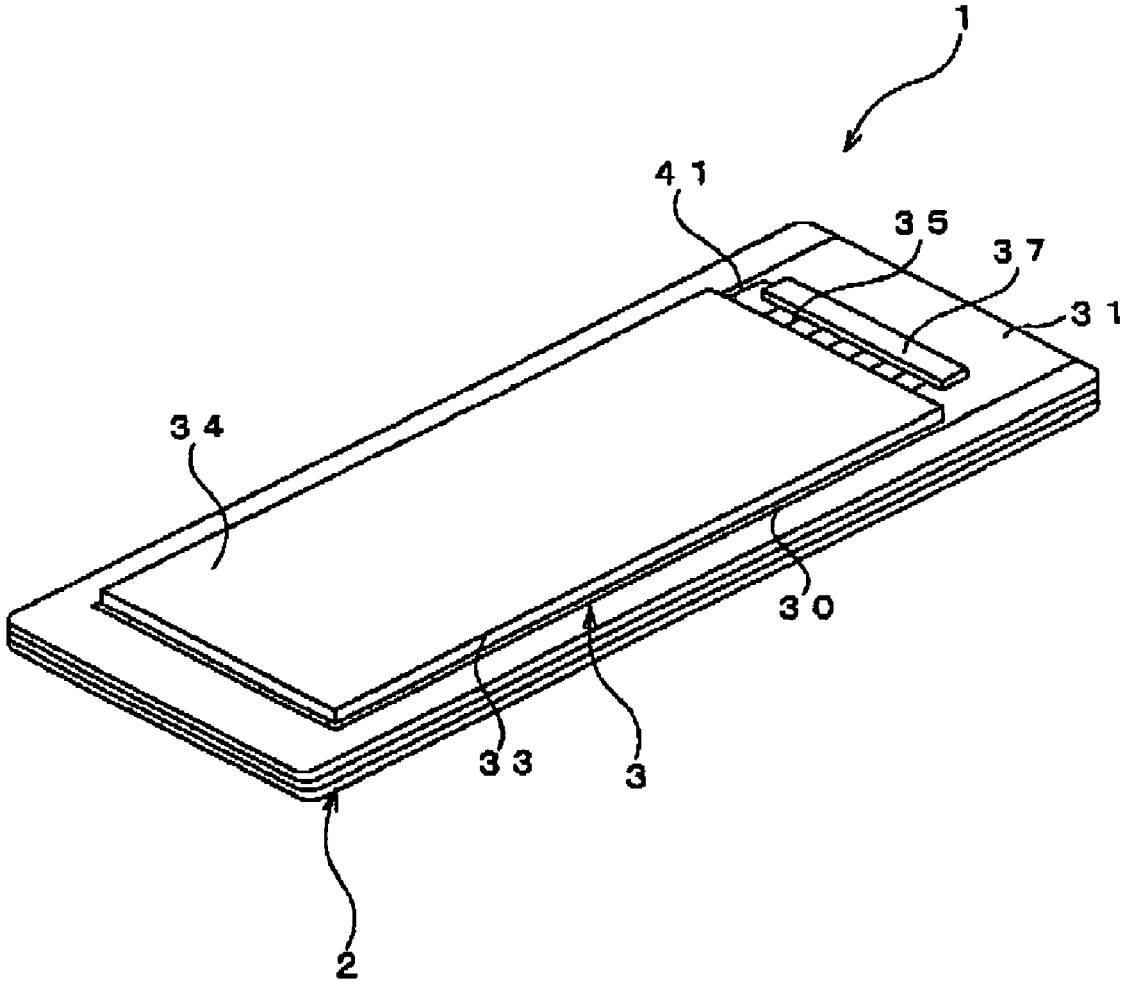
FIG. 1 is a perspective view of an inkjet recording head as a first embodiment of the present invention.

Hereinafter, there will be described preferred embodiments of the present invention by reference to the drawings. As shown in FIG. 1, an inkjet recording head 1 as an embodiment of the present invention includes a channel unit 2 in which a plurality of ink channels are formed; and a piezoelectric actuator 3 that is stacked on an upper surface of the channel unit 2.

Figure 2:
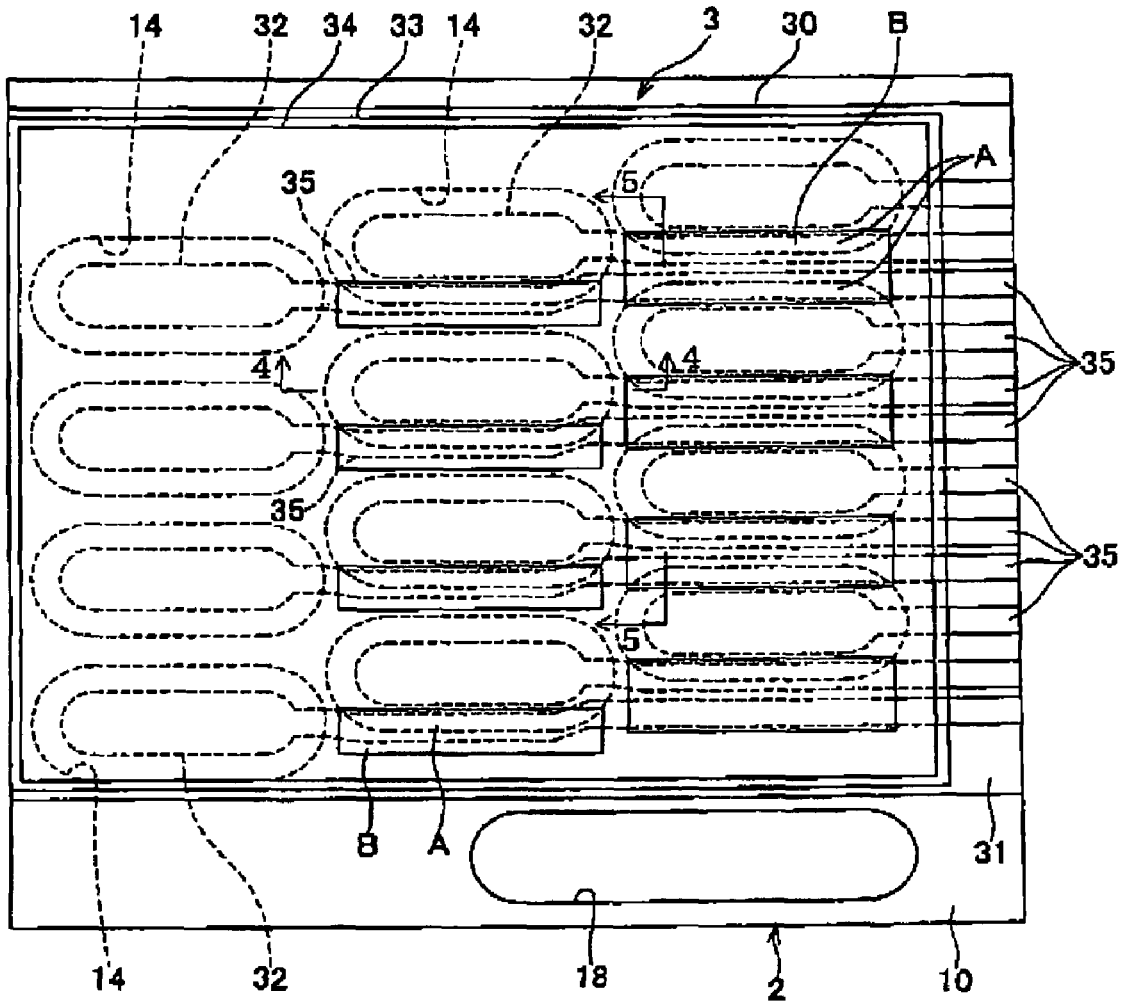
FIG. 2 is a plan view of a right-hand half portion of the inkjet recording head, shown in FIG. 1.
Figure 3:
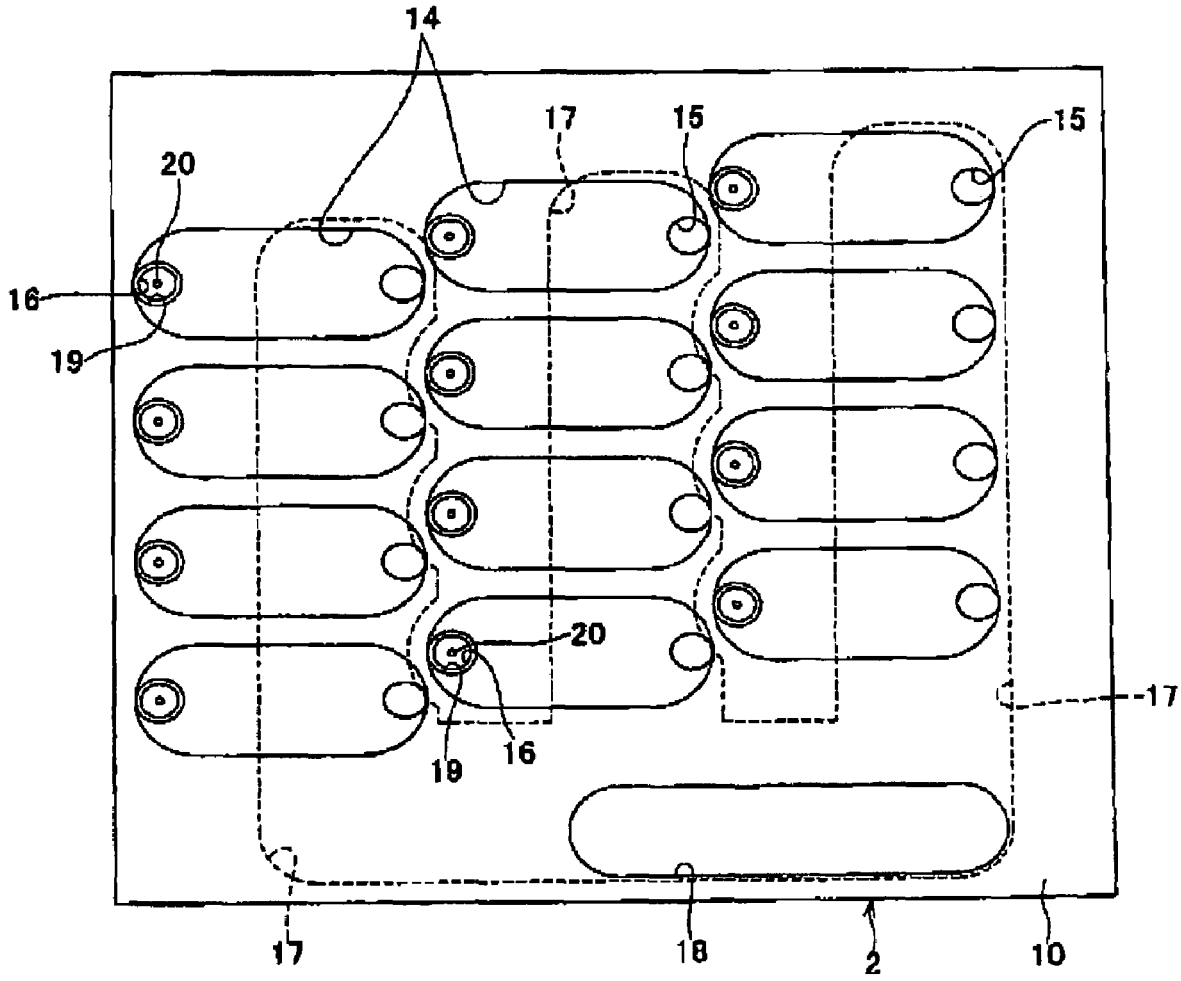
FIG. 3 is a plan view of a right-hand half portion of a channel unit of the inkjet recording head, shown in FIG. 1.
Figure 4:
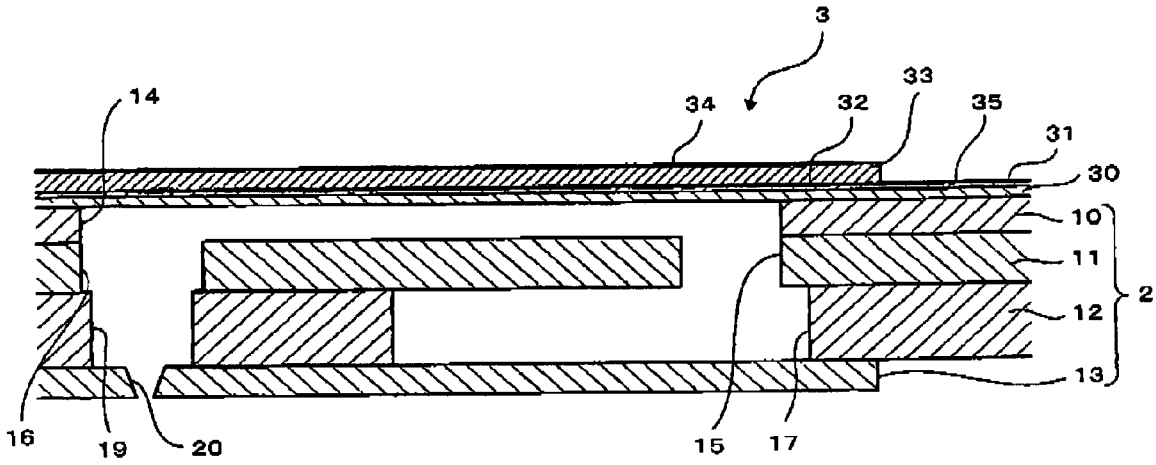
FIG. 4 is a cross-section view taken along 4-4 in FIG. 2.
Figure 5:
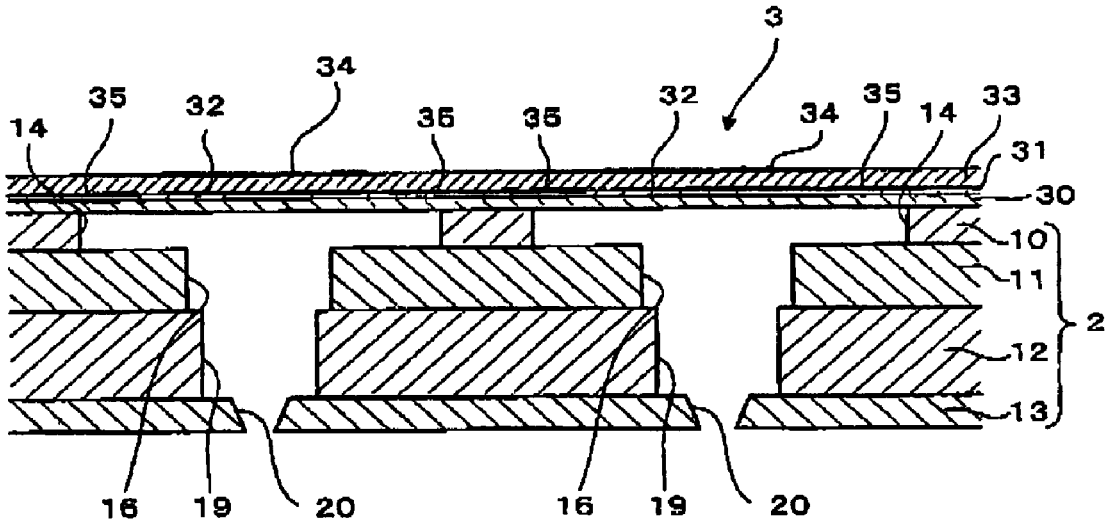
FIG. 5 is a cross-section view taken along 5-6 in FIG. 2.

First, the channel unit 2 is described in detail. FIG. 2 is a schematic plan view of a right-hand half portion of the inkjet recording head 1, shown in FIG. 1; FIG. 3 is a schematic plan view of a right-hand half portion of the channel unit 2, shown in FIG. 1; FIG. 4 is a cross-section view of the inkjet recording head 1, taken along 4-4 in FIG. 2; and FIG. 5 is a cross-section view of the inkjet recording head 1, taken along 5-5 in FIG. 2. As shown in FIGS. 2 through 5, the channel unit 2 includes a cavity sheet 10, a base sheet 11, a manifold sheet 12, and a nozzle sheet 13 that are stacked on, and adhered to, each other. Each of the cavity sheet 10, the base sheet 11, and the manifold sheet 12 has a generally rectangular shape, and is formed of a stainless-steel sheet. Thus, a plurality of ink channels including a plurality of manifolds 17 and a plurality of pressure chambers 14, described later, can be easily formed, by etching, in the three sheet members 10, 11, 12. Meanwhile, the nozzle sheet 13 is formed of, e.g., a high molecular synthetic resin material such as polyimide, and is adhered to a lower surface of the manifold sheet 12. However, like the other three sheet members 10, 11, 12, the nozzle sheet 13 may be formed of a stainless steel or any other suitable metallic material.

As shown in FIGS. 2 and 3, a plurality of pressure chambers 14 are formed in the cavity sheet 10, such that the pressure chambers 14 are arranged along a reference plane and each of the pressure chambers 14 opens in an upper plane surface of the cavity sheet 10, i.e., an upper plane surface of the channel unit 2 to which a diaphragm 30, described later, is bonded. FIGS. 2 and 3 show a portion of the pressure chambers 14, i.e., twelve pressure chambers 14 arranged in three arrays. Each of the pressure chambers 14 has a generally elliptic shape in a plan view thereof, and a major axis of the elliptic shape of the each pressure chamber 14 extends in a lengthwise direction of the cavity sheet 10.

As shown in FIGS. 3 and 4, the base sheet 11 has a first and a second communication hole 15, 16 that are formed in respective portions thereof that are aligned, in a plan view thereof, with respective opposite end portions of each of the pressure chambers 14 that are opposite to each other in the major-axis direction of the each pressure chamber 14. FIG. 3 shows twelve first communication holes 15 arranged in three arrays, and twelve second communication holes 16 arranged in three arrays. The manifold sheet 12 has three manifolds 17 formed therein such that each of the three manifolds 17 extends in a widthwise direction thereof and is aligned, in a plan view thereof, with respective right-hand half portions of the pressure chambers 14 of a corresponding one of the three arrays, shown in FIG. 3. The manifolds 17 are supplied with ink from an ink tank, not shown, via an ink supply inlet 18 formed in the cavity sheet 10. In addition, the manifold sheet 12 has a third communication hole 19 formed in a portion thereof that is aligned, in the plan view thereof, with the left-hand end portion of each of the pressure chambers 14, shown in FIG. 3. FIG. 3 shows twelve third communication holes 19 arranged in three arrays. Moreover, the nozzle sheet 13 has a nozzle 20 formed in a portion thereof that is aligned, in the plan view thereof, with the left-hand end portion of each of the pressure chambers 14, shown in FIG. 3. FIG. 3 shows twelve nozzles 20 arranged in three arrays. The nozzles 20 are formed, using, e.g., an excimer laser, in a sheet formed of a high molecular synthetic resin material such as polyimide.

As shown in FIG. 4, the three manifolds 17 communicate with the pressure chambers 14 via the respective first communication holes 15, and the pressure chambers 14 communicate with the nozzles 14 via the second communication holes 16 and the third communication holes 19, respectively. Thus, the channel unit 2 has a plurality of individual ink channels in which ink flows from the manifolds 17 to the nozzles 20 via the pressure chambers 14.

Next, the piezoelectric actuator 3 is described in detail. As shown in FIGS. 1 through 6, the piezoelectric actuator 3 includes the diaphragm 30 that is provided on the surface of the channel unit 2; an insulating layer 31 that is formed on a surface of the diaphragm 30; a plurality of individual electrodes 32 that are formed on a surface of the insulating layer 31 such that the individual electrodes 32 are opposed to the pressure chambers 14, respectively; a single piezoelectric layer 33 that is formed over respective surfaces of the individual electrodes 32; and a common electrode 34 that is formed on a surface of the piezoelectric layer 33 and is opposed to each of the individual electrodes 32.

The diaphragm 30 has a generally rectangular shape in a plan view thereof and is formed of a stainless-steel sheet. The diaphragm 80 is stacked on, and bonded to, the upper surface of the cavity sheet 10, such that the diaphragm 30 closes respective upper openings of the pressure chambers 14. Since the diaphragm 30 is formed of the stainless-steel sheet that has a considerably high elastic modulus, the diaphragm 30 has a high rigidity, and accordingly the piezoelectric actuator 3 exhibits a high degree of responsiveness when the piezoelectric layer 83 is deformed to eject ink in a manner, described later. In addition, since the stainless-steel sheet has a considerably high strength, the piezoelectric actuator 3 exhibits a high degree of durability even if the actuator 3 may be repeatedly deformed. Moreover, the diaphragm 30 is bonded to the surface of the cavity sheet 10 that is likewise formed of the stainless-steel sheet. Therefore, the diaphragm 30 and the cavity sheet 10 have a similar thermal expansion coefficient, and accordingly can be bonded to each other with a high strength. In addition, the ink present in the channel unit 2 contacts the diaphragm 30 and the channel unit 2 each of which is formed of the stainless-steel sheet that has a high corrosion resistance. Therefore, even if any sort of ink may be used with the inkjet recording head 1, there are no possibilities that a local battery be produced in the channel unit 2 or the diaphragm 30. Since an appropriate ink can be selected without taking corrosion into consideration, a degree of freedom of the ink selection is increased.

The insulating layer 31 that is provided on the surface of the diaphragm 30 is formed of a ceramic material having a high elastic modulus, such as alumina, zirconia, or silicon nitride, and has a plane upper surface. Since the insulating layer 31 is formed of the ceramic material having the high elastic modulus, the piezoelectric actuator 3 exhibits an increased rigidity and an improved responsiveness. The insulating layer 31 may be formed by, e.g., an aerosol deposition method in which super-fine particles are impacted at high speeds and are deposited. Otherwise, the insulating layer 31 may be formed by a sol-gel method, a sputtering method, or a CDC (chemical vapor deposition) method.

The individual electrodes 32 are formed on the plane surface of the insulating layer 31, such that each of the individual electrodes 32 has, in a plan view thereof, a generally elliptic shape whose size is somewhat smaller than the size of each pressure chamber 14, and such that the each individual electrode 32 is opposed, in the plan view thereof, to a central portion of a corresponding one of the pressure chambers 14. The individual electrodes 32 are formed of an electrically conductive material such as gold. Each of the individual electrodes 32 is electrically insulated from one or more individual electrodes 32 located adjacent thereto, by the insulating layer 31.

On the surface of the insulating layer 31, a plurality of electric wires 35 extend from respective one ends of the plurality of individual electrodes 32 (i.e., respective right-hand ends of the same 32, shown in FIG. 2), parallel to the respective major-axis directions of the same 82, and are connected to a driver IC (integrated circuit) 37 (FIG. 1) that selectively supplies a drive voltage to an arbitrary one of the individual electrodes 32. The individual electrodes 32 and the electric wires 35 may be formed at once on the surface of the insulating layer 31, by screen-printing an electrically conductive paste thereon. Otherwise, the individual electrodes 32 and the electric wires 36 may be formed such that, first, a conductive layer is formed on the entire surface of the insulating layer 31, by a plating method, a sputtering method, a vapor deposition method, or the like and, then, a laser method, a mask method, or a resist method is used to remove certain portions of the conductive layer.

Figure 6:
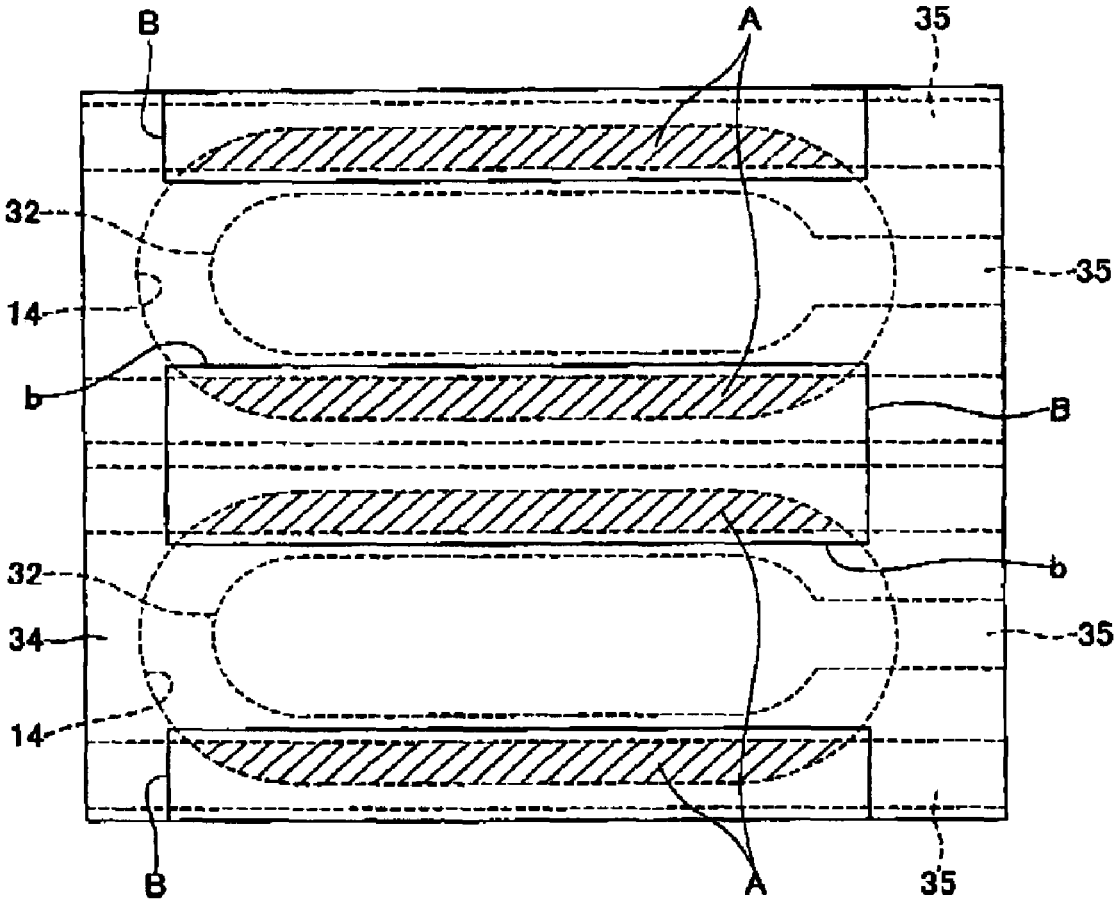
FIG. 6 is an enlarged view of a portion of the inkjet recording head, shown in FIG. 2.

As shown in FIGS. 2 and 6, a portion or portions A (indicated by hatching in FIG. 6) of one or more electric wires 35 overlaps or overlap, in a plan view of the inkjet recording head 1, i.e., as seen in a direction perpendicular to the reference plane along which the pressure chambers 14 are provided, a portion or respective portions of one or more pressure chambers 14 other than one or more pressure chambers 14 corresponding to one or more individual electrodes 32 from which the one or more electric wires 85 extends or extend. In contrast, in the piezoelectric actuator of the conventional inkjet recording head, as disclosed by the above-indicated Patent Document 1 or 2, the electric wires are provided in only the areas corresponding to the areas present between the pressure chambers, i.e., without overlapping the pressure chambers. Therefore, as compared with the electric wires of the conventional piezoelectric actuator, the electric wires 35 of the present piezoelectric actuator 3 can be provided in wider areas. Thus, a density at which the electric wires 35 are provided can be decreased, or otherwise a total number of the pressure chambers 14 can be increased without increasing the wire density.

The piezoelectric layer 33, provided on the respective surfaces of the individual electrodes 32, is formed of a composition containing, as a main component thereof, lead zirconate titanate (PZT) that is a solid solution of lead titanate and lead zirconate, and a ferroelectric material. The piezoelectric layer 33 is formed as a single, continuous layer that can encompass all the individual electrodes 32, i.e., can cover the respective surfaces of all the electrodes 32. The piezoelectric layer 33 may be directly formed on the surface of the insulating layer 31, by, e.g., the aerosol deposition method, the sol-gel method, the sputtering method, or the CDC method. Otherwise, the piezoelectric layer 38 may be directly formed on the surface of the insulating layer 31, by adhering a piezoelectric sheet constituted by fired PZT, to the surface of the insulating layer 31. In the latter case, first, the common electrode 34, described below, is formed by, e.g., screen-printing on one surface of the piezoelectric sheet and, then, the opposite surface of the sheet is adhered to the respective surfaces of the individual electrodes 32 Alternatively, a PZT green sheet that can be fired at low temperatures may be formed by, e.g., screen-printing on the surfaces of the individual electrodes 32. In the last case, the PZT green sheet needs to be fired at a temperature from 850° C. to 900° C.

The common electrode 34 that is common to all the individual electrodes 34 is formed on the entire surface of the piezoelectric layer 33, such that the common electrode 34 is opposed to each of the individual electrodes 32 via the piezoelectric layer 33. The common electrode 34 is connected via a single electric wire, not shown, to the driver IC 37, and is grounded via the same 37 so as to be maintained at a ground electric potential. Like the individual electrodes 82, the common electrode 34 may be formed using an electrically conductive material such as gold, and using the screen-printing method, the vapor deposition method, or the sputtering method.

When the piezoelectric actuator 3 is operated to eject a droplet of ink from an arbitrary nozzle 20, the driver IC 37 supplies, as will be described later, a drive voltage to the individual electrode 32 corresponding to the pressure chamber 14 communicating with that nozzle 20, more specifically described, the drive voltage to the individual electrode 32 via the corresponding electric wire 36. When the drive voltage is supplied to the individual electrode 32, an electric field is generated between the individual electrode 32 and the common electrode 34, so that a portion of the piezoelectric layer 33 that is located between the individual electrode 32 and the common electrode 34 is deformed and a pressure is applied via the diaphragm 30 to the ink present in the pressure chamber 14.

As previously described, the portion A of at least one electric wire 35 overlaps, in the plan view of the inkjet recording head 1, at least one pressure chamber 14 other than at least one pressure chamber 14 corresponding to at least one individual electrode 32 from which the at least one electric wire 35 extends. If a portion of the piezoelectric layer 33 that is opposed to the portion A directly contacts the common electrode 34, that portion of the piezoelectric layer 33 would be located between the one electric wire 35 and the common electrode 34. And, when the drive voltage is supplied to the one individual electrode 32 via the one electric wire 35 so as to drive or operate the corresponding pressure chamber 14, i.e., apply a pressure to the ink in the pressure chamber 14, then a certain degree of electric field would be generated between the portion A of the one electric wire 35 and the common electrode 34 and accordingly the portion of the piezoelectric layer 33, opposed to the portion A, would be deformed. Thus, a certain degree of pressure would be applied to the one pressure chamber 14 other than the one pressure chamber 14 that should be driven by the drive voltage, so that a certain amount of ink may leak from the nozzle 20 communicating with the other pressure chamber 14. This phenomenon is so-called "cross-talking" that may lower the printing quality of the inkjet recording head 1.

The above-indicated problem is solved by the present inkjet recording head 1. As shown in FIGS. 2 and 6, the common electrode 34 has an opening B that has a generally rectangular shape in the plan view of the recording head 1 and contains the portion or portions A of the one or two electric wires 35 that overlaps or overlap the one or two pressure chambers 14 other than the one or two pressure chambers 14 corresponding to the one or two electric wires 35. A portion of the piezoelectric layer 33 that is opposed to the opening B does not directly contact the common electrode 34. Therefore, if a drive voltage is applied to the one or two electric wire 359, no electric fields are generated in the portion of the piezoelectric layer 33 that is opposed to the portion or portions A of the one or two electric wires 36 that overlaps or overlap the above-indicated, other pressure chamber or chambers 14, and accordingly that portion of the same 33 is not deformed. Thus, the phenomenon of cross-talking can be restrained with reliability. The opening or openings B may be formed in the common electrode 34 in such a manner that, first, a conductive layer is formed on the entire surface of the piezoelectric layer 33, by the plating method, the sputtering method, the vapor deposition method, or the like and, then, the laser method, the mask method, or the resist method is used to remove, from the conductive layer, one or more portions corresponding to the one or more openings B. Otherwise, the common electrode 34 having the opening or openings B may be formed, in one step, by screen-printing on the surface of the piezoelectric layer 33.

The overlapping portion or portions A of one electric wires 35 cannot contact one or more individual electrodes 32 corresponding to one or more pressure chambers 14 other than one pressure chamber 14 corresponding to the one electric wire 35. Therefore, an outer periphery of each opening B of the common electrode 34, i.e., a boundary between the portion of the piezoelectric layer 33 that does not directly contact the common electrode 34, and a portion of the piezoelectric layer 33 that directly contacts the common electrode 34, includes one or two portions, b, that is or are located between one or two electric wires 35 and one or two individual electrodes 32 corresponding to the above-indicated other pressure chamber or chambers 14. Here, it is preferred that each portion b of the boundary be not located in the vicinity of one side edge of the corresponding electric wire 35 or an outer periphery of the corresponding individual electrode 82, but be located at an intermediate (e.g., middle) position therebetween. In this case, even if the electric wires 35 and/or the common electrode 34 having the openings B are formed at respective positions that are more or less deviated from respective correct positions in a widthwise direction of each pressure chamber 14, the portion or portions of the piezoelectric layer 33 that is or are opposed to the portion or portions A of the electric wire or wires 35 can be prevented from being sandwiched between the electric wire or wires 35 and the common electrode 34. Thus, the phenomenon of cross-talking can be restrained with higher reliabilities.

However, for example, in the case where an area of the portion A of one electric wire that overlaps the above-indicated other pressure chamber 14 is considerably small, the phenomenon of cross-talking may not occur even if the portion of the piezoelectric layer 33 that is opposed to the portion A may be deformed. In this case, the common electrode 34 may not have any openings B, i.e., may be constituted by a single, wholly continuous layer having no openings or gaps. Therefore, the common electrode 34 can be easily formed.

Next, there will be described an operation of the piezoelectric actuator 3 for ejecting droplets of ink from the nozzles 20. When the driver IC 37 selectively supplies a drive voltage to an arbitrary one (or ones) of the individual electrodes 32 via the corresponding electric wire (or wires) 35, an electric potential of the one individual electrode 32, located under the piezoelectric layer 33, is made different from an electric potential, i.e., the ground potential, of the common electrode 34, located on the piezoelectric layer 33, so that an electric field is generated in a vertical direction, in a portion of the piezoelectric layer 3 that is sandwiched between the one individual electrode 32 and the common electrode 34. Consequently the sandwiched portion of the piezoelectric layer 33 that is polarized, in advance, in a vertical direction is shrunk in a horizontal direction perpendicular to the polarization direction. Since the insulating layer 31 and the diaphragm 30 that are located under the piezoelectric layer 33 are fixed to the cavity sheet 10, the sandwiched portion of the piezoelectric layer 33 is deformed to protrude toward the corresponding pressure chamber 14, and this deformation of the piezoelectric layer 33 causes a portion of the diaphragm 30 that covers the pressure chamber 14 to be deformed to protrude into the pressure chamber 14. Thus, since the volume of the pressure chamber 14 is decreased, the pressure of the ink present in the pressure chamber 14 is increased, so that a droplet of ink is ejected from the nozzle 20 communicating with the pressure chamber 14.

The inkjet recording head 1 constructed as described above enjoys the following advantages: 1) the portion A of at least one of the electric wires 35 overlaps, in the plan view of the inkjet recording head 1, i.e., as seen in the direction perpendicular to the reference plane along which the pressure chambers 14 are provided, a portion of at least one pressure chamber 14 other than at least one pressure chamber 14 corresponding to at least one individual electrode 32 from which the at least one electric wire 35 extends. Therefore, the electric wires 35 can be provided in the wider areas, and accordingly the density at which the electric wires 35 are provided can be decreased. Thus, the increase of the production cost and/or the decrease of the production yield can be avoided. In addition, the electric wires 35 that are connected to the individual electrodes 32 so as to supply the drive voltages to the same 32 can be provided with improved reliability. Otherwise, the total number of the pressure chambers 14 can be increased without increasing the wire density. In the latter case, the inkjet recording head 1 can perform printing at higher speeds and with higher qualities.

2) The portion of the piezoelectric layer 33 that is opposed to the portion A of at least one electric wire 35 that overlaps at least one pressure chamber 14 other than at least one pressure chamber 14 corresponding to the at least one electric wire 35, does not directly contact the common electrode 34. Therefore, when the drive voltage is supplied to the one electric wire 35, no electric field is generated in the portion of the piezoelectric layer 33, opposed to the portion A, and accordingly the portion of the layer 33 is not deformed. Thus, the phenomenon of cross-talking can be effectively prevented.

3) Since the common electrode 34 is formed on the surface of the piezoelectric layer 33, the opening or openings B that contains or contain the portion or portions A of the electric wire or wires 35 that overlaps or overlap the pressure chamber or chambers 14 other than the pressure chamber or chambers 14 corresponding to the electric wire or wires 35, can be easily formed through the thickness of the common electrode 34, by removing, using, e.g., the laser method, the appropriate portion or portions of the common electrode 34 formed on the piezoelectric layer 33. Thus, the portion or portions of the piezoelectric layer 33 that is or are opposed to the portion or portions A of the electric wire or wires 35 is or are prevented from directly contacting the common electrode 34.

Next, there will be described other embodiments of the present invention. The same reference numerals as used in the above-described first embodiment are used to designate the corresponding elements or parts of the following embodiments, and the description thereof is omitted, as needed.

Figure 7:
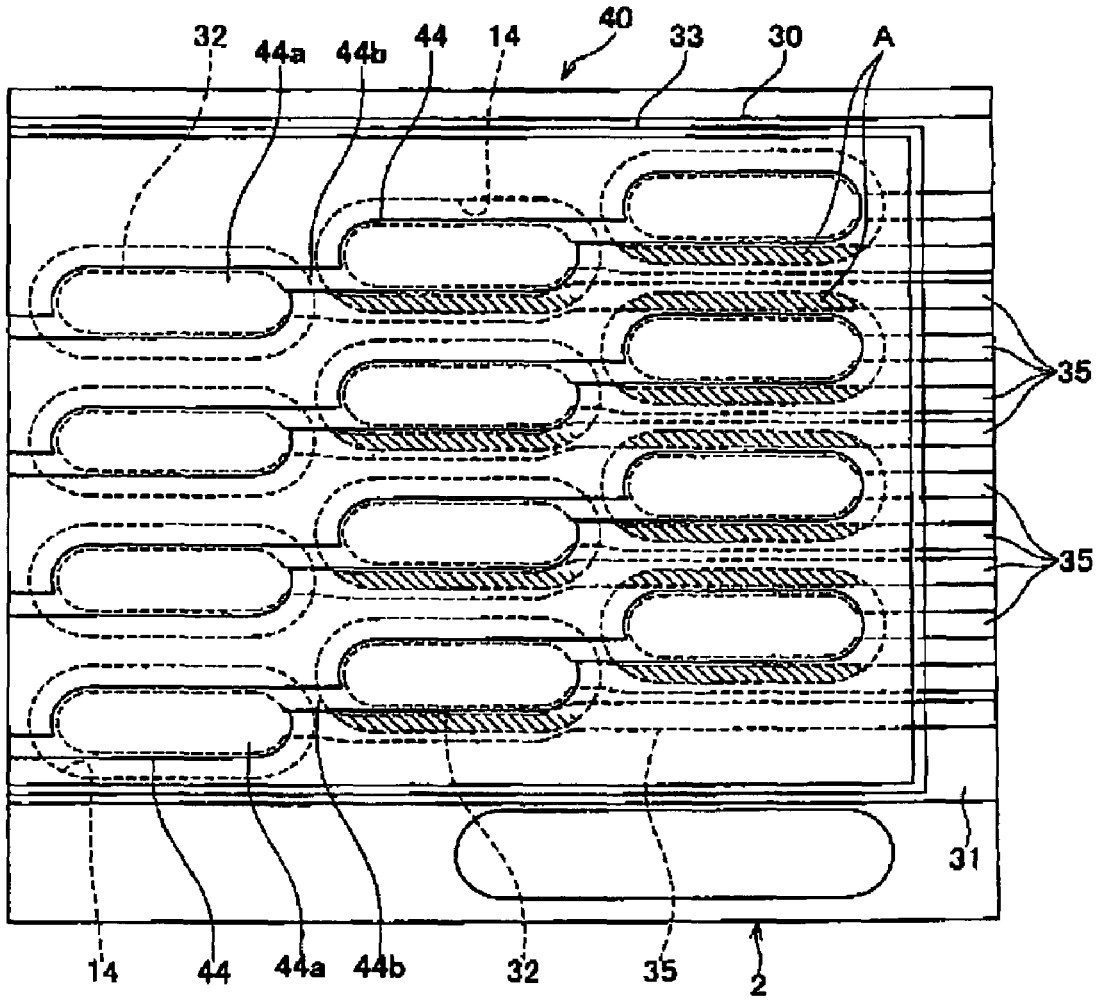
FIG. 7 is a plan view corresponding to FIG. 2, showing another inkjet recording head as a second embodiment of the present invention.

In the first embodiment shown in FIGS. 1 through 6, the opening or openings B is or are formed only around the portion or portions A of the electric wire or wires 35 that overlaps or overlap the pressure chamber or chambers 14 other than the pressure chamber or chambers 14 corresponding to the electric wire or wires 35. However, in a piezoelectric actuator 40, shown in FIG. 7, as a second embodiment of the present invention, a common electrode 44 is constituted by a plurality of opposed portions 44*a* that are substantially opposed to the plurality of individual electrodes 32, respectively, and a plurality of connection portions 44*b* that connect the opposed portions 44*a* to each other. Thus, like the first embodiment, a portion or portions of the piezoelectric layer 33 that is or are opposed to a portion or portions A of the electric wire or wires 35 is or are prevented from directly contacting the common electrode 44. In addition, since a total area in which all the electric wires 35 are opposed to the common electrode 44 can be minimized, an unnecessary electric capacity that is generated between the electric wires 35 and the common electrode 44 can be minimized. Though, in this case, it is needed to form, on the surface of the piezoelectric layer 33, a wring pattern for the common electrode 44, this wiring pattern can be easily formed by, e.g., the screen-printing method.

In the first embodiment, the pressure chambers 14 include, as shown in FIG. 2, some pressure chambers 14 that do not overlap any electric wires 35. In addition, regarding the pressure chambers 14 that overlap the electric wires 35, respective areas of the respective overlapping portions of those pressure chambers 14 may differ from each other, because those pressure chambers 14 may overlap one electric wire 35 or two electric wires 35. Therefore, the rigidity of the piezoelectric actuator 3 that covers the pressure chambers 14 may change with respect to the different pressure chambers 14, and accordingly respective ink ejecting characteristics of the nozzles 20 communicating with the pressure chambers 14 may change, which may lead to lowering the printing quality of the inkjet recording head 1. However, in a piezoelectric actuator 50, shown in FIG. 8, as a third embodiment of the present invention, the rigidity of the piezoelectric actuator 50 is made substantially uniform by providing one or more dummy electrodes 51 that overlaps or overlap a portion or portions of one or more pressure chambers 14 and does or do not overlap any individual electrodes 32 or any electric wires 35. No drive voltage is supplied to the dummy electrode or electrodes 51.

Figure 8:
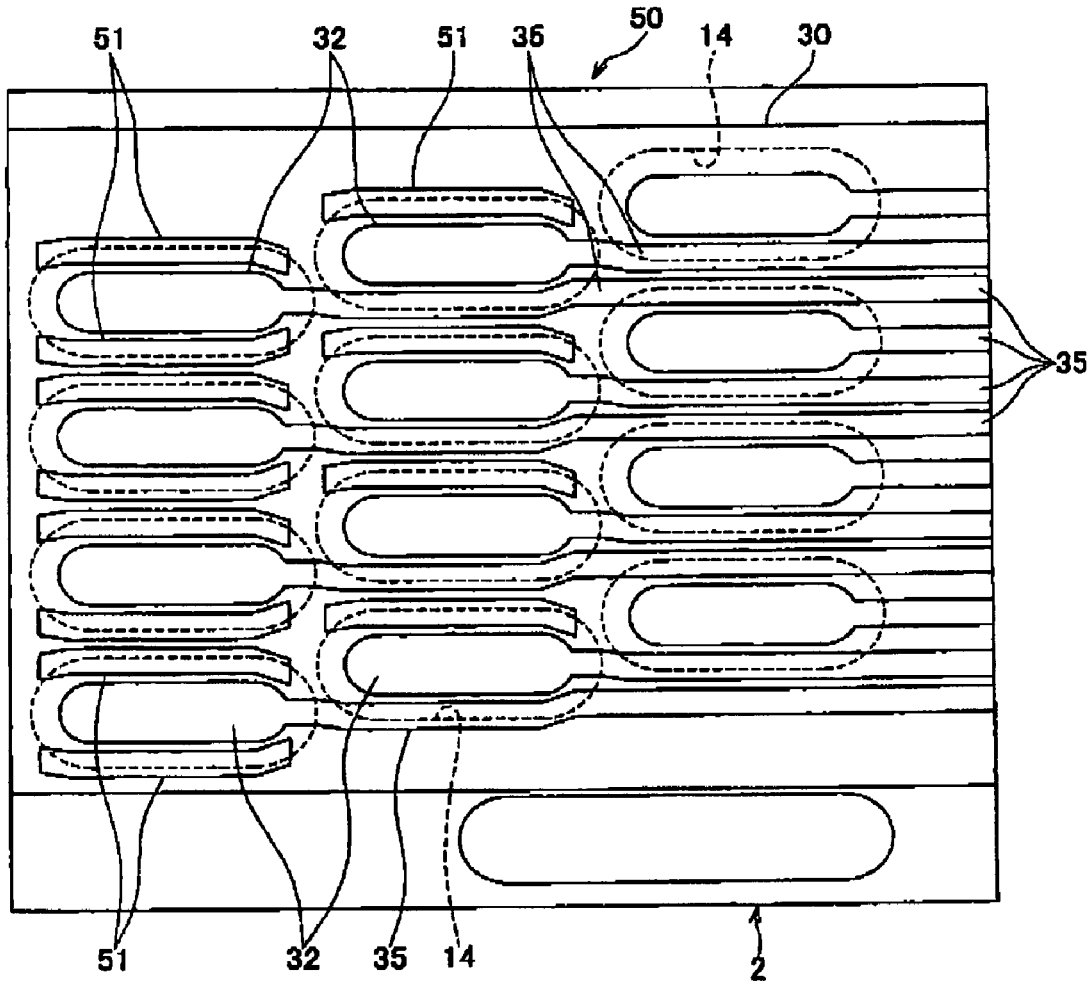
FIG. 8 is a plan view corresponding to FIG. 2, showing another inkjet recording head as a third embodiment of the present invention.

As shown in FIG. 8, in the case where the plurality of electric wires 35 extend from the plurality of individual electrodes 32, in a rightward direction as seen in the figure, a total area of the electric wires 35 provided around the pressure chambers 14 located in a left-hand portion of the piezoelectric actuator 50, i.e., located on an upstream side as seen in the direction of extension of the wires 35, is smaller than a total area of the electric wires 35 provided around the pressure chambers 14 located in a right-hand portion of the piezoelectric actuator 50, i.e., located on a downstream side as seen in the direction of extension. Hence, in the piezoelectric actuator 50, a ratio of a total area of a portion or portions of one or more dummy electrodes 51 that overlaps or overlap each of the pressure chambers 14 located on the upstream side, to an entire area of the each pressure chamber 14, is made greater than a ratio of a total area of a portion or portions of one or more dummy electrodes 51 that overlaps or overlap each of the pressure chambers 14 located in the downstream side, to an entire area of the each pressure chamber 14, in the direction of extension of the electric wires 35. In addition, it is preferred that a sum of the area or respective areas of the portion or portions A of the electric wire or wires 35 that overlap or overlaps each of the pressure chambers 14, and the area or respective areas of the portion or portions of the dummy electrode or electrodes 51 that overlap or overlaps the each pressure chamber 14 be substantially constant in the direction of extension of the electric wires 35. Regarding the example shown in FIG. 8, a sum of respective areas of the respective portions A of two electric wires 35 that overlap one pressure chamber 14 or each of a plurality of pressure chambers 14, a sum of respective areas of the respective portions of two dummy electrodes 51 that overlap one pressure chamber 14 or each of a plurality of pressure chambers 14, and a sum of the area of the portion A of one electric wire 35 that overlaps one pressure chamber 14 or each of a plurality of pressure chambers 14 and the area of the portion of one dummy electrode 51 that overlaps the one or each pressure chamber 14 are substantially constant. In this case, the piezoelectric actuator 50 can have a substantially uniform rigidity with respect to respective portions thereof corresponding to the pressure chambers 14, and accordingly the nozzles 20 communicating with the pressure chambers 14 can have a substantially uniform, ink ejecting characteristic.

Figure 9:
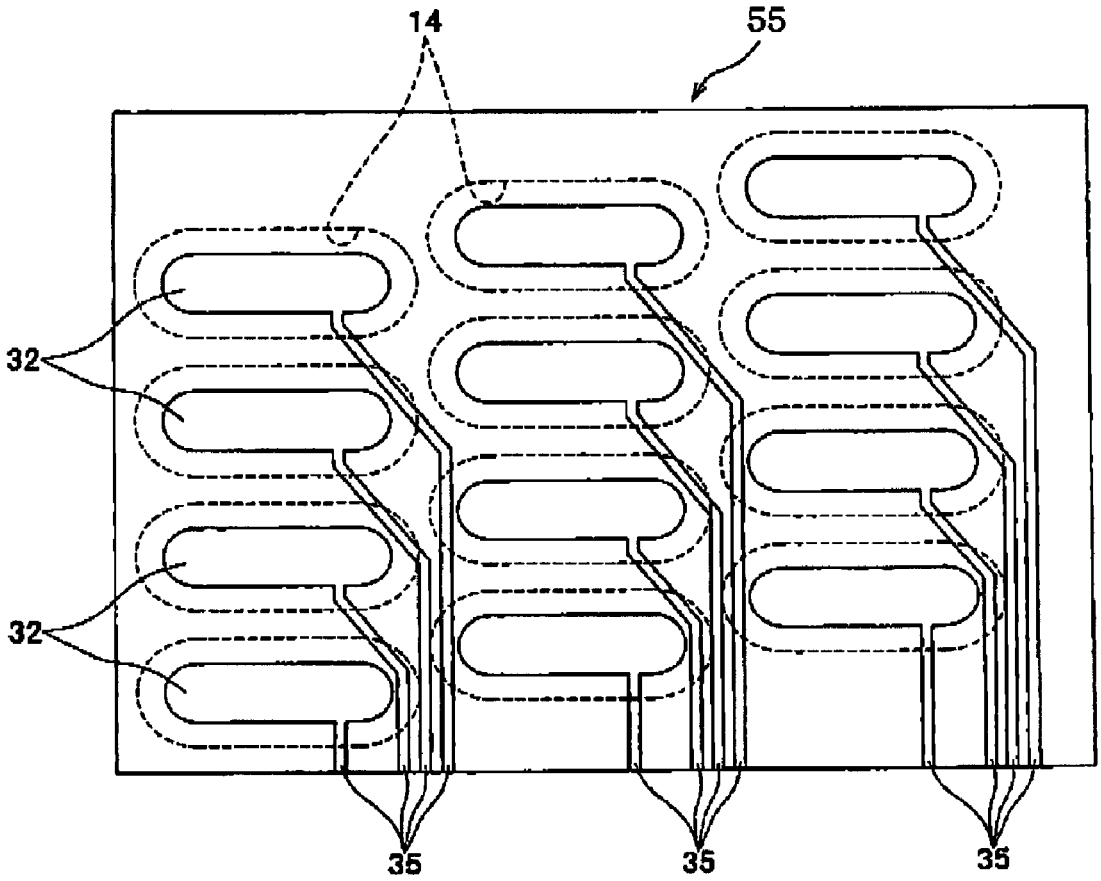
FIG. 9 is a plan view corresponding to FIG. 2, showing another inkjet recording head as a fourth embodiment of the present invention.

In the first embodiment, the electric wires 35 extend from the individual electrodes 32 in the respective major-axis directions thereof. However, the electric wires 35 may be formed in a different direction. For example, in a piezoelectric actuator 55, shown in FIG. 9, as a fourth embodiment of the present invention, electric wires 35 extend from individual electrodes 32 in respective minor-axis directions thereof. Otherwise, the electric wires 35 may extend from some of the individual electrodes 32 in one direction thereof and from the other individual electrodes 32 in a different direction thereof.

Figure 10:
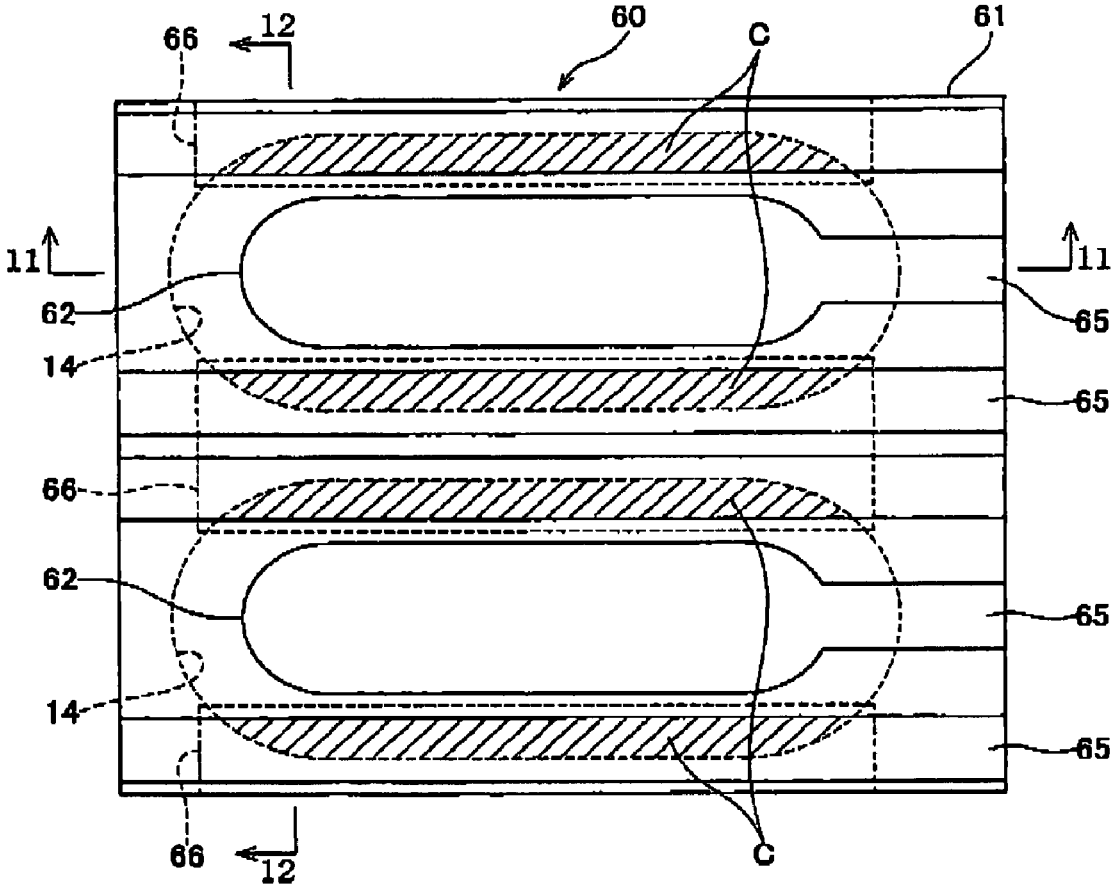
FIG. 10 is a plan view corresponding to FIG. 6, showing another inkjet recording head as a fifth embodiment of the present invention.
Figure 11:
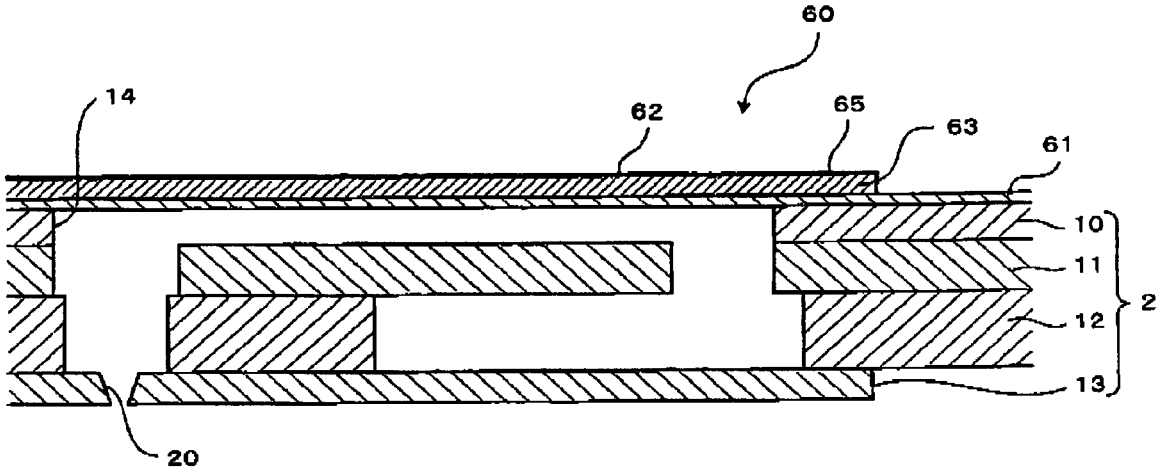
FIG. 11 is a cross-section view taken along 11-11 in FIG. 10.
Figure 12:
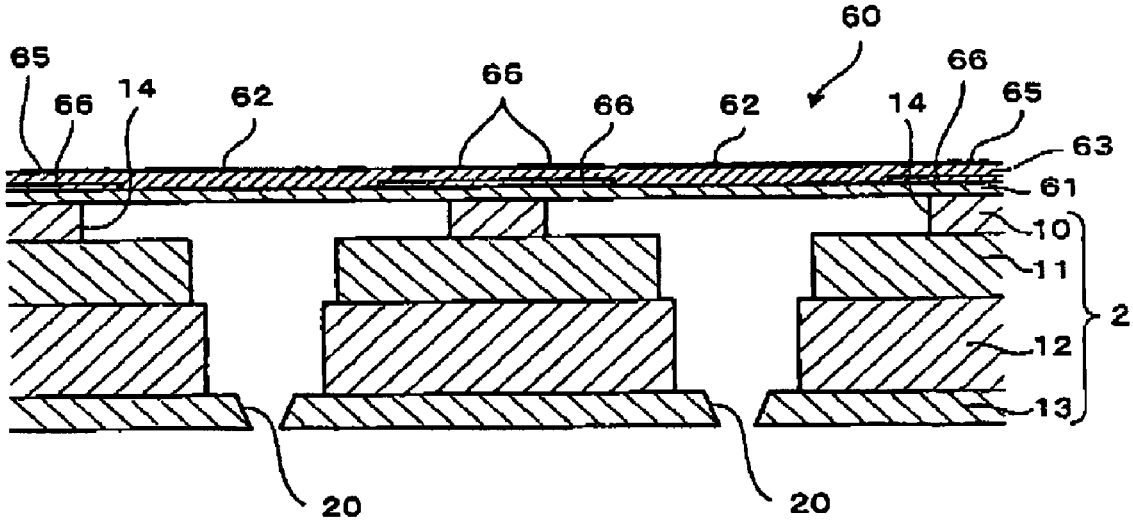
FIG. 12 is a cross-section view taken along 12-12 in FIG. 10.

In the first embodiment, the individual electrodes 32 are provided on the lower side of the piezoelectric layer 33, and the common electrode 34 is provided on the upper side of the same 33. However, this arrangement is not essential. In a piezoelectric actuator 60, shown in FIGS. 10 through 12, as a fifth embodiment of the present invention, individual electrodes 62 and a common electrode 61 are provided upside down. More specifically described, the piezoelectric actuator 60 includes a diaphragm that is bonded to the upper surface of the channel unit 2, is formed of a metal sheet such as stainless-steel sheet, and functions as the common electrode 61; a piezoelectric layer 63 that is formed on a surface of the diaphragm 61; and a plurality of individual electrodes 62 and a plurality of electric wires 65 that are formed on a surface of the piezoelectric layer 63. As shown in FIG. 10, a portion C of at least one electric wire 65 overlaps, in a plan view of the piezoelectric actuator 60, a portion of at least one pressure chamber 14 other than at least one pressure chamber 14 corresponding to the at least one electric wire 65.

The diaphragm 61 functioning as the common electrode directly covers the respective upper openings of the pressure chambers 14. Therefore, for the purpose of preventing a portion or portions of the piezoelectric layer 63 that is or are opposed to the portion or portions C of the electric wire or wires 65 that overlaps or overlap the pressure chamber or chambers 14 other than the pressure chamber or chambers 14 corresponding to the electric wire or wires 65, from directly contacting the diaphragm 61 as the common electrode, it is not possible to form, through a thickness of the diaphragm 61, any openings similar to the openings B, as shown in FIG. 6, that are formed by removing the appropriate portions of the common electrode 34. Hence, in the piezoelectric actuator 60, one or more electrically insulating layers 66 is or are formed, on the surface of the diaphragm 61, such that the insulating layer or layers 66 has or have a generally rectangular shape in a plan view thereof and has or have an area or respective areas that is or are able to cover fully the portion or portions C of the electric wire or wires 65 that overlaps or overlap the pressure chamber or chambers 14 other than the pressure chamber or chambers 14 corresponding to the electric wire or wires 65. Thus, a lower surface or surfaces of the portion or portions of the piezoelectric layer 63 that is or are opposed to the portion or portions C of the electric wire or wires 65 that overlaps or overlap the above-indicated, other pressure chamber or chambers 14 contacts or contact the insulating layer or layers 66 so as to be electrically insulated thereby, and accordingly does or do not directly contact the diaphragm 61 as the common electrode. Thus, when a drive voltage is supplied to an arbitrary one or ones of the individual electrodes 62, the present piezoelectric actuator 60 can effectively restrain, like the piezoelectric actuator 3 employed in the first embodiment, the phenomenon of cross-talking wherein one or more pressure chambers 14 other than one or more pressure chambers 14 corresponding to the arbitrary individual electrode or electrodes 62 are driven or operated. Meanwhile, since the insulating layer or layers 66 is or are formed on the surface of the diaphragm 61, the surface of the diaphragm 61 is not even, i.e., is more or less rough. Therefore, it is preferred that the piezoelectric layer 63 be formed on the surface of the diaphragm 61 by an appropriate method that ensures that the particles of PZT closely adhere to the surface of the diaphragm 61; such as the aerosol deposition method, the sol-gel method, the sputtering method, or the CDC method.

It is to be understood that the present invention may be embodied with other changes, modifications, and improvements that may occur to a person skilled in the art, without departing from the spirit and scope of the invention defined in the appended claims.

What is claimed is:

1. An inkjet recording head, comprising:

a channel unit which has, along a reference plane, a plurality of pressure chambers communicating with a plurality of nozzles, respectively, each of which ejects a droplet of ink; and a piezoelectric actuator which changes a volume of an arbitrary one of the pressure chambers so that a corresponding one of the nozzles ejects the droplet of ink, wherein the piezoelectric actuator includes a plurality of individual electrodes corresponding to the plurality of pressure chambers, respectively, a common electrode which is opposed to each of the individual electrodes in a direction perpendicular to the reference plane, a piezoelectric layer which is interposed between the common electrode and each of the individual electrodes, and a plurality of electric wires which are connected to the plurality of individual electrodes, respectively, so as to supply respective drive voltages to the individual electrodes, and wherein a portion of at least one of the electric wires that is connected to at least one first individual electrode of the individual electrodes that corresponds to at least one first pressure chamber of the pressure chambers overlaps, as seen in the direction perpendicular to the reference plane, (a) a portion of at least one second pressure chamber of the pressure chambers that differs from said at least one first pressure chamber and (b) at least one first portion of the piezoelectric layer that overlaps said portion of said at least one second pressure chamber; and wherein said at least one first portion of the piezoelectric layer does not directly contact the common electrode.

2. The inkjet recording head according to claim 1, wherein a portion of at least one boundary between at least one second portion of the piezoelectric layer that directly contacts the common electrode and at least one third portion of the piezoelectric layer that does not directly contact the common electrode and contains said at least one first portion is located, as seen in the direction perpendicular to the reference plane, between said portion of said at least one electric wire and at least one second individual electrode of the individual electrodes that corresponds to said at least one second pressure chamber.

3. The inkjet recording head according to claim 1, wherein the common electrode consists of a plurality of opposed portions that are substantially opposed, as seen in the direction perpendicular to the reference plane, to the plurality of individual electrodes, respectively, and a plurality of connection portions each of which connects corresponding two opposed portions of the plurality of opposed portions, to each other.

4. The inkjet recording head according to claim 1, wherein the piezoelectric actuator further includes at least one dummy electrode at least a portion of which overlaps, as seen in the direction perpendicular to the reference plane, a portion of at least one of the pressure chambers, no portion of which overlaps any of the individual electrodes and the electric wires, and to which no electric voltage is supplied.

5. The inkjet recording head according to claim 4, wherein the electric wires extend from the individual electrodes, respectively, in a reference direction, and wherein a ratio of an area of at least a portion of at least one first dummy electrode of a plurality of said dummy electrodes that overlaps a portion of at least one third pressure chamber of the pressure chambers that is located in an upstream-side portion of the piezoelectric actuator as seen in the reference direction, to an area of an entirety of said at least one third pressure chamber, is greater than a ratio of an area of at least a portion of at least one second dummy electrode of the plurality of dummy electrodes that overlaps a portion of at least one fourth pressure chamber of the pressure chambers that is located on a downstream-side portion of the piezoelectric actuator as seen in the reference direction, to an area of an entirety of said at least one fourth pressure chamber.

6. The inkjet recording head according to claim 4, wherein, as seen in the direction perpendicular to the reference plane, each of the pressure chambers overlaps, by a substantially constant area, at least one of (a) a portion of at least one of the electric wires, and (b) a portion of at least one of a plurality of said dummy electrodes.

7. The inkjet recording head according to claim 1, wherein the piezoelectric actuator further includes a diaphragm which is provided on a surface of the channel unit and which is formed of a metal; and an insulating layer which is provided on a surface of the diaphragm, wherein the individual electrodes and the electric wires are provided on a surface of the insulating layer, wherein the piezoelectric layer is provided on respective surfaces of the individual electrodes and the electric wires, and wherein the common electrode is provided on a surface of the piezoelectric layer.

8. The inkjet recording head according to claim 1, wherein the common electrode comprises a diaphragm which is provided on a surface of the channel unit, wherein the piezoelectric layer is provided on a surface of the diaphragm, wherein the individual electrodes and the electric wires are provided on a surface of the piezoelectric layer, and wherein the piezoelectric actuator further includes at least one insulating portion which is provided on the surface of the diaphragm such that said at least one insulating portion is opposed, as seen in the direction perpendicular to the reference plane, said portion of said at least one electric wire that overlaps said portion of said at least one second pressure chamber.

9. The inkjet recording head according to claim 1, wherein each of the individual electrodes is opposed, as seen in the direction perpendicular to the reference plane, to a central portion of a corresponding one of the pressure chambers, and wherein said portion of said at least one electric wire overlaps an outer peripheral portion of said at least one second pressure chamber.

10. The inkjet recording head according to claim 1, wherein the common electrode has at least one opening which contains, as seen in the direction perpendicular to the reference plane, said at least one first portion of the piezoelectric layer that overlaps said portion of said at least one electric wire.

11. The inkjet recording head according to claim 1, wherein the electric wires extend from the individual electrodes, respectively, in a first direction, wherein the individual electrodes are arranged in at least three arrays each of which extends in a second direction intersecting the first direction, and wherein the plurality of electric wires include at least two electric wires which extend through an area between two adjacent individual electrodes of the plurality of individual electrodes that are adjacent to each other.

12. The inkjet recording head according to claim 11, wherein each of the pressure chambers is elongated in the first direction.

13. The inkjet recording head according to claim 11, wherein each of the pressure chambers is elongated in the second direction.

14. The inkjet recording head according to claim 1, wherein the channel unit has, along the reference plane, the plurality of pressure chambers such that the plurality of pressure chambers do not overlap each other as seen in the direction perpendicular to the reference plane.

* * * * *

UNITED STATES PATENT AND TRADEMARK OFFICE

CERTIFICATE OF CORRECTION

PATENT NO. : 7,578,579 B2
APPLICATION NO. : 11/147233
DATED : August 25, 2009
INVENTOR(S) : Hiroto Sugahara It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 881 days.

Signed and Sealed this

Seventh Day of September, 2010

David J. Kappos

David J. Kappos
*Director of the United States Patent and Trademark Office*